US007277654B2

(12) United States Patent
DeMoor et al.

(10) Patent No.: US 7,277,654 B2
(45) Date of Patent: Oct. 2, 2007

(54) ELECTROPHOTOGRAPHIC POWER SUPPLY CONFIGURATION FOR SUPPLYING POWER TO A FUSER

(75) Inventors: Mark K. DeMoor, Nicholasville, KY (US); John W Kietzman, Lexington, KY (US); Gregory H. McClure, Lexington, KY (US); William A. Menk, Jr., Lexington, KY (US); Calvin D. Murphy, Georgetown, KY (US); Lawrence G. Teply, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 196 days.

(21) Appl. No.: 11/166,807

(22) Filed: Jun. 24, 2005

(65) Prior Publication Data

US 2006/0291891 A1 Dec. 28, 2006

(51) Int. Cl.
*G03G 15/00* (2006.01)
*G03G 15/20* (2006.01)

(52) U.S. Cl. ..... 399/88; 399/30; 399/37; 399/320

(58) Field of Classification Search ..... 219/216, 219/486; 399/88, 90, 320, 37
See application file for complete search history.

(56) References Cited

U.S. PATENT DOCUMENTS 3,398,259 A 8/1968 Tregay et al.
3,998,539 A 12/1976 Kidd
4,340,807 A 7/1982 Raskin et al.
4,576,462 A 3/1986 Lehman
4,825,242 A 4/1989 Elter
5,041,718 A 8/1991 d'Hondt et al.
5,191,375 A 3/1993 Hamilton
5,300,996 A 4/1994 Yokoyama et al.

(Continued)

FOREIGN PATENT DOCUMENTS

JP 5-249864 9/1993

(Continued)

OTHER PUBLICATIONS

U.S. Appl. No. 10/887,163, filed Jul. 8, 2004, Cook et al. entitled A Resistive Heater Comprising First and Second Resistive Traces, A Fuser Subassembly Including Such a Resistive Heater and a Universal Heating Apparatus Including First and Second Resistive Traces (pending application).

*Primary Examiner*—Hoang Ngo
(74) *Attorney, Agent, or Firm*—Stevens & Showalter, LLP

(57) ABSTRACT

A power supply control system for a fuser assembly in an electrophotographic apparatus includes a power supply and a fuser assembly. The power supply includes a first electrical path designated for a fuser assembly that operates at a first voltage and a second electrical path designated for a fuser assembly that operates at a second voltage. The fuser assembly is configured to operate at a select one of the first voltage or the second voltage and is connected to the first electrical path if the fuser assembly operates at the first voltage, and the fuser assembly is connected to the second electrical path if the fuser assembly operates at the second voltage. The first and second electrical paths allow different device features including power limiting devices such as fuses, switches, relays, etc., to be placed in each path.

25 Claims, 5 Drawing Sheets

U.S. PATENT DOCUMENTS

| | | | | |
|---|---|---|---|---|
| 5,350,896 | A | 9/1994 | Amico et al. | |
| 5,376,773 | A | 12/1994 | Masuda et al. | |
| 5,483,149 | A | 1/1996 | Barrett | |
| 5,497,218 | A | 3/1996 | Amico | |
| 5,512,993 | A | 4/1996 | Endo et al. | |
| 5,671,462 | A | 9/1997 | Toyohara et al. | |
| 5,708,949 | A | 1/1998 | Kasahara et al. | |
| 5,789,723 | A | 8/1998 | Hirst | |
| 5,819,134 | A | 10/1998 | Sato et al. | |
| 5,826,152 | A | 10/1998 | Suzuki et al. | |
| 5,854,959 | A | 12/1998 | Mirabella, Jr. | |
| 5,862,436 | A | 1/1999 | Ishizawa et al. | |
| 5,899,599 | A | 5/1999 | Kato | |
| 5,925,278 | A | 7/1999 | Hirst | |
| 6,008,829 | A | 12/1999 | Wakamiya et al. | |
| 6,011,939 | A | 1/2000 | Martin | |
| 6,178,299 | B1 | 1/2001 | Kim | |
| 6,229,120 | B1 | 5/2001 | Jewell | |
| 6,243,547 | B1 | 6/2001 | Mizuno et al. | |
| 6,289,185 | B1 | 9/2001 | Cahill | |
| 6,301,454 | B1 | 10/2001 | Nishida et al. | |
| 6,317,571 | B1 | 11/2001 | Adams | |
| 6,336,009 | B1 | 1/2002 | Suzumi et al. | |
| 6,353,718 | B1 | 3/2002 | Roxon et al. | |
| 6,385,410 | B1 | 5/2002 | Hanyu et al. | |
| 6,423,941 | B1 | 7/2002 | Kanari et al. | |
| 6,522,844 | B2 | 2/2003 | Yamane et al. | |
| 6,539,185 | B2 | 3/2003 | Hanyu et al. | |
| 6,768,884 | B1 | 7/2004 | Buchheit | |
| 6,870,140 | B2 * | 3/2005 | Cook et al. | 219/486 |
| 2002/0043523 | A1 | 4/2002 | Fujita et al. | |
| 2002/0061199 | A1 | 5/2002 | Horobin et al. | |
| 2002/0085851 | A1 | 7/2002 | Murata et al. | |
| 2004/0188416 | A1 | 9/2004 | Cao et al. | |
| 2004/0232137 | A1 | 11/2004 | Cook et al. | |
| 2004/0245236 | A1 | 12/2004 | Cook et al. | |

FOREIGN PATENT DOCUMENTS

| | | |
|---|---|---|
| JP | 5-346749 | 12/1993 |
| JP | 7-121055 | 5/1995 |
| JP | 11-233243 | 8/1999 |
| JP | 2001-142547 | 5/2001 |
| JP | 2002-043028 | 2/2002 |
| JP | 2002-055554 | 2/2002 |

* cited by examiner

ELECTROPHOTOGRAPHIC POWER SUPPLY CONFIGURATION FOR SUPPLYING POWER TO A FUSER

BACKGROUND OF THE INVENTION

The present invention relates in general to an electrophotographic imaging apparatus, and more particularly to power supply configurations that allow the electrophotographic imaging apparatus to accommodate fusers having different voltage requirements.

In electrophotography, a latent image is created on an electrostatically charged photoconductive surface by exposing select portions of the surface to laser light. Essentially, the density of the electrostatic charge on the photoconductive surface is altered in areas exposed to a laser beam relative to those areas unexposed to the laser beam. The latent electrostatic image thus created is developed into a visible image by exposing the photoconductive surface to toner, which contains pigment components and thermoplastic components. When so exposed, the toner is attracted to the photoconductive surface in a manner that corresponds to the electrostatic density altered by the laser beam. The toner pattern is subsequently transferred from the photoconductive surface to the surface of a print medium, such as paper, which has been given an electrostatic charge opposite that of the toner.

A fuser then applies heat and pressure to the print medium before it is discharged from the apparatus. The heat causes constituents including the thermoplastic components of the toner to flow into the interstices between the fibers of the medium and the pressure promotes settling of the toner constituents in these voids. As the toner is cooled, it solidifies and adheres the image to the medium.

Many fusing applications require precise control over fuser temperatures to ensure that the toner adequately adheres to the print medium. To generate the appropriate temperatures, the fuser often includes a resistive heating device, such as a halogen lamp, that operates at the main supply voltage that powers the apparatus. Temperature is controlled by switching the power supply to the heating device on and off as necessary, e.g., using a triac or similar control device. Due at least in part to the resistive characteristics of the heating device, such fusers are typically designed to operate on narrow voltage ranges. However, the world has relatively large variations in power line standards. For example, line voltages typically range around 100 volts of alternating current (VAC) in Japan, about 110 VAC to 127 VAC, in the United States and about 220 VAC to 240 VAC in Europe.

As such, a manufacturer may be required to provide a different product version of an electrophotographic apparatus where the apparatus is to be used in geographic locations having different main power line standards. This makes supply chain planning complicated because demand for several apparatus configurations must be predicted, rather than only needing to predict aggregate demand. The different product versions further create the potential that a fuser intended for one voltage range of operation is installed in an apparatus that is configured for a second voltage of operation, which can cause improper operation of the apparatus.

SUMMARY OF THE INVENTION

The present invention provides a power supply control system for a fuser in an electrophotographic device that includes a power supply having a first circuit branch designated for a fuser that operates at a first voltage and a second circuit branch designated for a fuser that operates at a second voltage. A fuser is connected to the first circuit branch if the fuser operates at the first voltage, and the fuser is connected to the second circuit branch if the fuser operates at the second voltage.

For example, the power supply may receive a nominal input voltage at a select one of 115V, corresponding to the first voltage, or 230V corresponding to the second voltage. Under this arrangement, the electrical circuit that couples the input voltage to the corresponding fuser comprises a first circuit branch for fusers intended for 115V operation. Similarly, the electrical circuit comprises a second circuit branch for fusers intended for 230V operation. The first and second circuit branches allow different device features including power limiting devices such as fuses, switches, relays, etc., to be placed in each circuit branch. Thus, an electrophotographic device can be configured to accommodate fusers having different voltage requirements by connecting a 115V fuser to the first circuit branch, or by connecting a 230V fuser to the second fuser branch.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
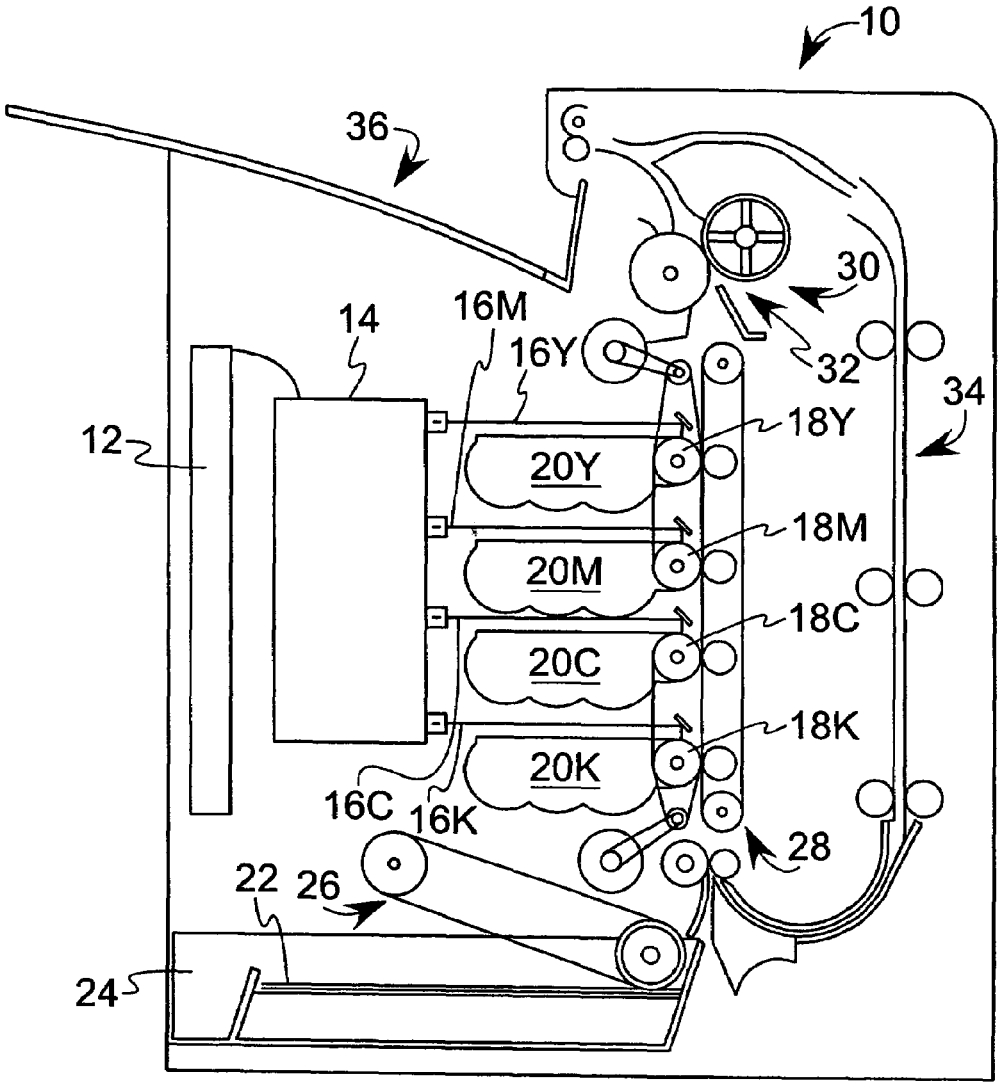
FIG. 1 is a side schematic view of an exemplary electrophotographic device.

Referring now to the drawings, and particularly to FIG. 1, an exemplary electrophotographic imaging apparatus is indicated generally by the reference numeral 10. An image to be printed is electronically transmitted to a main system controller 12 by an external device (not shown). The main system controller 12 includes system memory, one or more processors, and other logic and circuits necessary to control the functions of electrophotographic imaging. For color operation, the image to be printed is de-constructed into four bitmap images corresponding to the cyan, yellow, magenta and black (CYMK) image planes, e.g., by the main system controller 12 or by the external device.

The main system controller 12 initiates an imaging operation whereby a printhead 14 generates a first modulated laser beam signal 16K, which forms a latent image on a photoconductive drum 18K of a first image forming station 20K corresponding to the black bitmap image data. A second modulated laser beam signal 16C forms a latent image on a photoconductive drum 18C of a second image forming station 20C corresponding to the cyan bitmap image data. A third modulated laser beam signal 16M forms a latent image on a photoconductive drum 18M of a third image forming station 20M corresponding to the magenta bitmap image data. Similarly, a fourth modulated laser beam signal 16Y forms a latent image on a photoconductive drum 18Y of a fourth image forming station 20Y corresponding to the yellow bitmap image data.

The main system controller 12 also coordinates the timing of a printing operation to correspond with the imaging operation, whereby a top sheet 22 of a stack of media is picked up from a media tray 24 by a pick mechanism 26 and is delivered to a media transport belt 28. The media transport belt 28 carries the sheet 22 past each of the four image forming stations 20K, 20C, 20M and 20Y, which apply toner to the sheet 22 in patterns corresponding to the latent images written to their associated photoconductive drums 18K, 18C, 18M and 18Y, respectively. The media transport belt 28 then carries the sheet 22 with the four color images superposed thereon to a fuser system 30. The fuser system 30 includes a fuser assembly 32 comprising a pair of fuser rolls that define a nip for receiving the sheet 22. The fuser rolls provide energy in the form of heat to the sheet 22 in the nip area, which causes the toner images on the sheet 22 to melt. When the toner subsequently cools, it solidifies and adheres to the sheet 22. The fuser assembly 32 may alternatively comprise a heated belt and a corresponding backup member, a heated fuser roll and a backup member such as a belt, or other nip forming structures. Upon exiting the fuser system 30, the sheet 22 is either fed into a duplexing path 34 for printing on a second surface thereof, or the sheet 22 is ejected from the apparatus 10 to an output tray 36.

Figure 2:
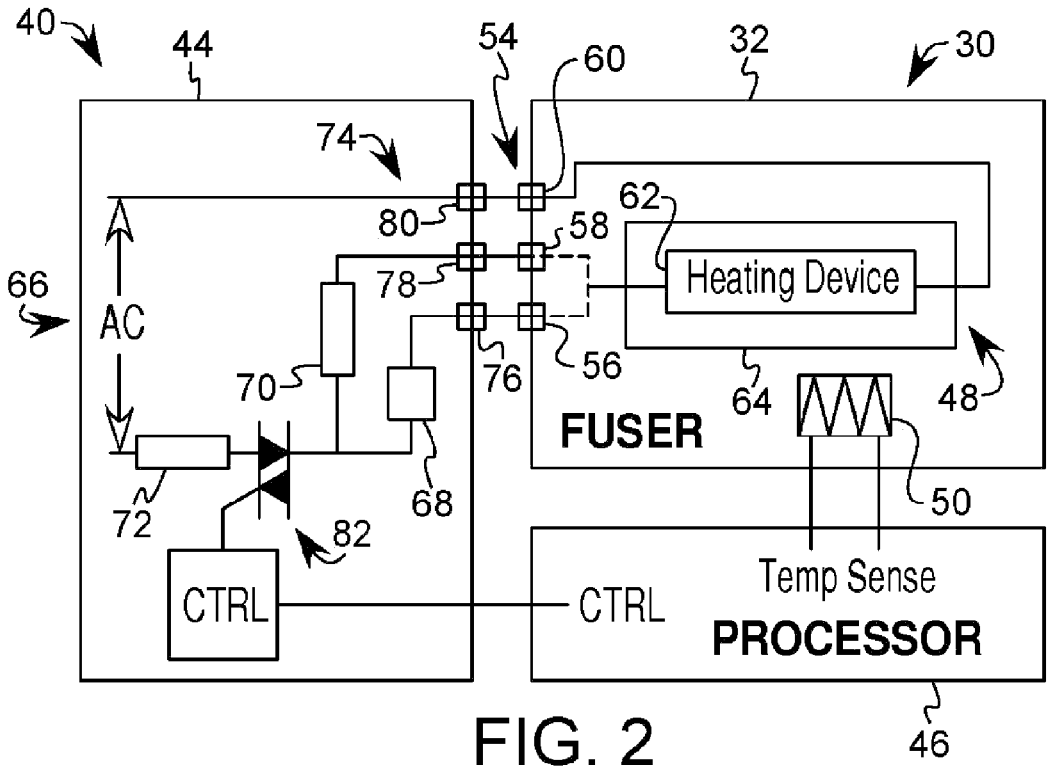
FIG. 2 is a block diagram illustration of a power supply control system for a fuser according to the present invention.

A schematic illustration of a configuration for controlling and monitoring the fuser assembly 32 is illustrated in FIG. 2. In general, a power supply control system 40 comprises a power supply 44 for delivering power to the fuser assembly 32 and a fuser processor 46 for controlling and/or monitoring power delivered to the fuser assembly 32 via the power supply 44. The power supply control system 40 may be suitably implemented as part of the fuser system 30 discussed herein with reference to FIG. 1. The power supply control system 40 may alternatively be implemented in other fuser assembly arrangements and apparatuses, examples of which are discussed above. Moreover, the power supply 44 may deliver power to other components of the apparatus 10. However, power connections to additional components of the apparatus are not illustrated in the figures for purposes of clarity of discussion herein.

The control functions of the fuser processor 46 may be implemented in the main system controller 12, which is illustrated in FIG. 1. Alternatively, the fuser processor 46 may be integrated with, or provided as a subsystem of the main system controller 12 or the fuser processor 46 may comprise separate hardware and/or software which are distinct from the controller 12.

In addition to the nip forming structures discussed above, the fuser assembly 32 includes a heating device 48, a first sensor 50 and a fuser-side power connector body 54. The fuser-side power connector body 54 includes a first fuser-side connection point 56, a second fuser-side connection point 58 and a third fuser-side connection point 60. An electrical circuit path couples the third fuser-side connection point 60 of the fuser-side power connector body 54 to the heating device 48. Additionally, the heating device 48 is electrically coupled to a select one of either the first fuser-side connection point 56 or the second fuser-side connection point 58 as illustrated by the dashed lines as shown. Thus, the heating device 48 is unconnected to the remainder one of either the first fuser-side connection point 56 or the second fuser-side connection point 58. Different arrangements may alternatively be provided for coupling the heating device 48 to the fuser-side power connector body 54. Moreover, while three fuser-side connection points 56, 58, 60 are illustrated, the actual number of implemented connection points may vary, depending upon factors such as the number of heating elements 48 provided in the fuser assembly 32 and the manner in which the fuser assembly 32 is interconnected to the power supply 44.

The heating device 48 may comprise a heat source 62 and a corresponding heater member 64 that provides a suitable support for the heat source 62. In one exemplary arrangement, the heat source 62 comprises a halogen lamp and the heater member 64 comprises a support for the halogen lamp. However, other heat sources 62, including ceramic heaters may alternatively be provided. Additionally, the particular construction of the heater member 64 will vary depending upon the particular implementation of the fuser assembly 32 and the corresponding heat source 62.

During a fusing operation, AC power is supplied to the heating device 48 such that heat is generated in the area of the pressure nip through which media passes to fuse toner to the corresponding sheet as schematically illustrated in FIG. 1. Moreover, the fuser assembly 32 may provide heat to a single element, e.g., a roll or belt, or alternatively, heat may be provided to multiple elements of the fuser assembly 32, depending for example, upon the specific configuration and heating requirements of the fuser assembly 32. For example, in a monochrome device, a heated roll may comprise an aluminum core covered with a nonstick coating and the heating device 48 may comprise a halogen lamp positioned within the core.

For color printing applications, fuser rolls are typically covered in rubber to permit nip shapes conducive to releasing thick layers of toner. Although heated rolls use rubber coverings as thermally conductive as reasonably possible, heat transfer through these rolls is slower than heat transfer through the hot rolls that are suitable for use in fuser systems intended for monochrome apparatuses. Thus, the slower response times through such rubber covered rolls may be compensated by splitting heating power between two components of the fuser assembly 32, such as a heated hot roll and a heated backup roll. As such, although only one heating device 48 is illustrated for purposes of clarity of discussion, the fuser assembly 32 may in practice, include multiple heating devices 48.

The first sensor 50, e.g., a thermistor, provides a temperature measurement which is processed by the fuser processor 46. Thus, the first sensor 50 is placed at a location where a suitable fuser assembly 32 temperature measurement can be taken, e.g., at the hot roll. This arrangement allows the fuser processor 46 to control the temperature of the fuser assembly 32 in a manner that is appropriate for the intended fusing application.

The power supply 44 includes a power input 66 for receiving an AC line voltage, a first power limiting device 68, a second power limiting device 70, a third power limiting device 72 and a power supply-side connector body 74 for connecting the AC power supply 44 to the fuser assembly 32 using a suitable interconnection arrangement. The power supply-side connector body 74 corresponds to the fuser-side power connector body 54 as shown, and thus includes a first power supply-side connection point 76, a second power supply-side connection point 78, and a third power supply-side connection point 80. The power supply 44 further includes a power control device 82 that is controlled by the fuser processor 46 for selectively applying power to the fuser assembly 32.

In the illustrative example, the power input of the power supply 66 is electrically coupled through a first shared circuit path segment, which includes the third power limiting device 72 and the power control device 82 as shown. The power input 66 is coupled from the first shared circuit path segment to the first power supply-side connection point 76 through a first circuit branch, which includes the first power limiting device 68. The power input 66 is also coupled from the first shared circuit path segment to the second power supply-side connection point 78 through a second circuit branch, which includes the second power limiting device 70. An additional (second) shared electrical path couples the power input 66 of the power supply 44 to the third power supply-side connection point 80. Additional electrical paths may further be provided, for example, to accommodate other signals to the fuser assembly 32 or other components in the apparatus.

Also as shown, the first power supply-side connection point 76 is interconnected to the first fuser-side connection point 56, the second power supply-side connection point 78 is interconnected to the second fuser-side connection point 58 and the third power supply-side connection point 80 is interconnected to the third fuser-side connection point 60. This may be accomplished by integrating the fuser-side power connector body 54 into the fuser assembly 32 and by integrating the power supply-side connector body 74 into the power supply 44. Alternatively, an intermediate coupling device, such as a suitable wiring harness, connectors, plugs, sockets etc., may be used to interconnect the fuser assembly 32 to the power supply 44. For example the fuser-side power connector body 54 may be integrated into a connector, e.g., a fuser-side autoconnect, which further couples to the heating device 48 of the fuser assembly 32. Similarly, the power supply-side connector body 74 may be implemented in a connector, e.g., a machine-side autoconnect, that further couples back to the power supply 44. In this regard, the fuser-side autoconnect is mated with the machine-side autoconnect to establish an electrical connection between the fuser assembly 32 and the power supply 44.

Regardless of whether the fuser-side power connector body 54 resides directly on the fuser assembly 32, or on a suitable connecting arrangement, an electrical connection is made to the heating device 48 of the fuser assembly 32 between only a select one of the first and second fuser-side connection points 56, 58. Thus, the remainder one of the first and second fuser-side connection points 56, 58, e.g., that is unconnected to the heating device 48, will be unused and thus need not be electrically coupled back to its corresponding power supply-side connection point 76, 78. Thus, the first, second and third fuser-side connection points 56, 58, 60, and correspondingly, the first, second and third power supply-side connection points 76, 78, 80 represent points where electrical interconnections may be formed between the fuser assembly 32 and the power supply 44, but no physical electrical connection is required for unused connection points. Moreover, alternative interconnection arrangements between the fuser assembly 32 and the power supply 44 may be provided.

The heating device 48 of the fuser assembly 32 is electrically coupled to a select one of the first or second fuser-side connection points 56, 58. Thus, the heating device 48 is corresponding electrically coupled to a select one of the first or second circuit branches in the power supply 44 via the corresponding electrical connection between the fuser-side power connector body 54 and the power supply-side connector body 74.

Under this arrangement, a first type fuser assembly that is designed for operation at a first range of voltages may include a first type heating device that receives power from the power input 66 of the power supply 44 via a first electrical circuit formed between the power supply 44 and the first type fuser assembly. The first electrical circuit is formed through the power supply 44 to the first power supply-side connection point 76 by the first shared circuit path segment, which includes the third power limiting device 72, and the first circuit branch, which includes the first power limiting device 68. The first electrical circuit is further formed through the interconnection between the first power supply-side connection point 76 and the first fuser-side connection point 56. An electrical connection of the first type fuser assembly couples the first type heating device between the first and third fuser-side connection points 56, 60. The first electrical circuit is further formed through the interconnection between the third fuser-side connection point 60 and the third power supply-side connection point 80, and within the power supply 44 by the second shared electrical path in the power supply 44 from the third power supply-side connection point 80 back to the power input 66.

Similarly, a second type fuser assembly that is designed for operation at a second range of voltages different from the first range of voltages may include a second type heating device that receives power from the power input 66 of the power supply 44 via a second electrical circuit formed between the power supply 44 and the second type fuser assembly. The second electrical circuit is formed through the power supply 44 to the second power supply-side connection point 78 by the first shared circuit path segment, which includes the third power limiting device 72, and the second circuit branch, which includes the second power limiting device 70. The second electrical circuit is further formed through the interconnection between the second power supply-side connection point 78 and the second fuser-side connection point 58. An electrical connection of the second type fuser assembly couples the second type heating device between the second and third fuser-side connection points 58, 60. The second electrical circuit is further formed through the interconnection between the third fuser-side connection point 60 and the third power supply-side connection point 80 and within the power supply 44 by the second shared electrical path in the power supply 44 from the third power supply-side connection point 80 back to the power input 66.

Thus, the apparatus may, for example, accommodate power supply conditions of differing geographies by selection of either the first type fuser assembly or the second type fuser assembly 32 without modifying the power supply 44. Further, there may be no need to modify the interconnection between the fuser assembly 32 and the power supply 44 when changing the fuser assembly 32 between the first type and second type.

Within the power supply 44, the first power limiting device 68 in the first circuit branch may be tailored to the power requirements of the first type fuser assembly 32 having the first type heating device 48 when so installed in the apparatus. Similarly, the second power limiting device 70 in the second circuit branch may be tailored to the power requirements of the second type fuser assembly 32 having the second type heating device 48 when so installed in the apparatus. The third power limiting device 72 is positioned in the first shared circuit segment regardless of the type of fuser assembly 32 that is installed in the apparatus and thus has power limiting characteristics that are suitable for fuser assemblies 32 having either of the first or second type heating devices 48.

The power control device 82, which is illustrated in the first shared circuit path segment, is provided to control power supplied to the fuser assembly 32. In one illustrative embodiment, the power control device 82 comprises a triac and an optical isolator (opto-isolator), although other electrical devices may alternatively be used. The fuser processor 46 controls the triac to selectively turn on and off the power to the heating device 48 in the installed fuser assembly 32, e.g., based upon temperature measurements determined from the first sensor 50 and the temperature requirements of a particular fusing application.

As shown, the fuser processor 46 controls the power control device 82 in the power supply 44, which switches the AC power supplied to the heating device 48 of the fuser assembly 32 between on and off states. If the fuser processor 46 determines that the fuser assembly 32 has become too hot for a particular fusing application, such as based upon the temperature measurement from the first sensor 50, the fuser processor 46 will turn off the supply of AC line power to the fuser assembly 32 via the power control device 82 until the temperature of the fuser assembly 32 system falls to a predetermined proper value or range of values intended for the particular fusing application. The fuser processor 46 may also be designed to control the power supplied to the fuser assembly 32 when certain apparatus conditions occur. For example, the fuser processor 46 may be programmed to turn off the power supplied to the fuser assembly 32 via the power control device 82 in the event of a paper jam or other detected operational or environmental condition.

Figure 3:
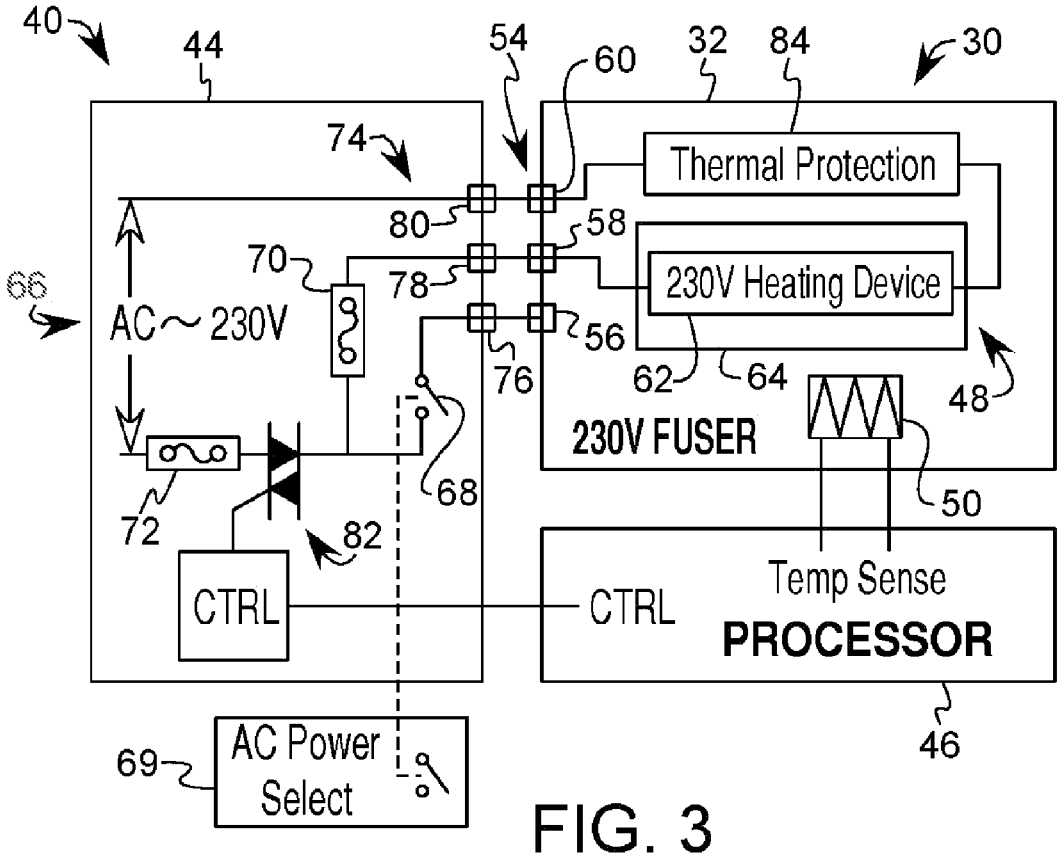
FIG. 3 is a block diagram illustration of a power supply control system according to the present invention, in which a power supply operating at 230V is coupled to a 230V fuser assembly having a 230V heating device installed therein.
Figure 4:
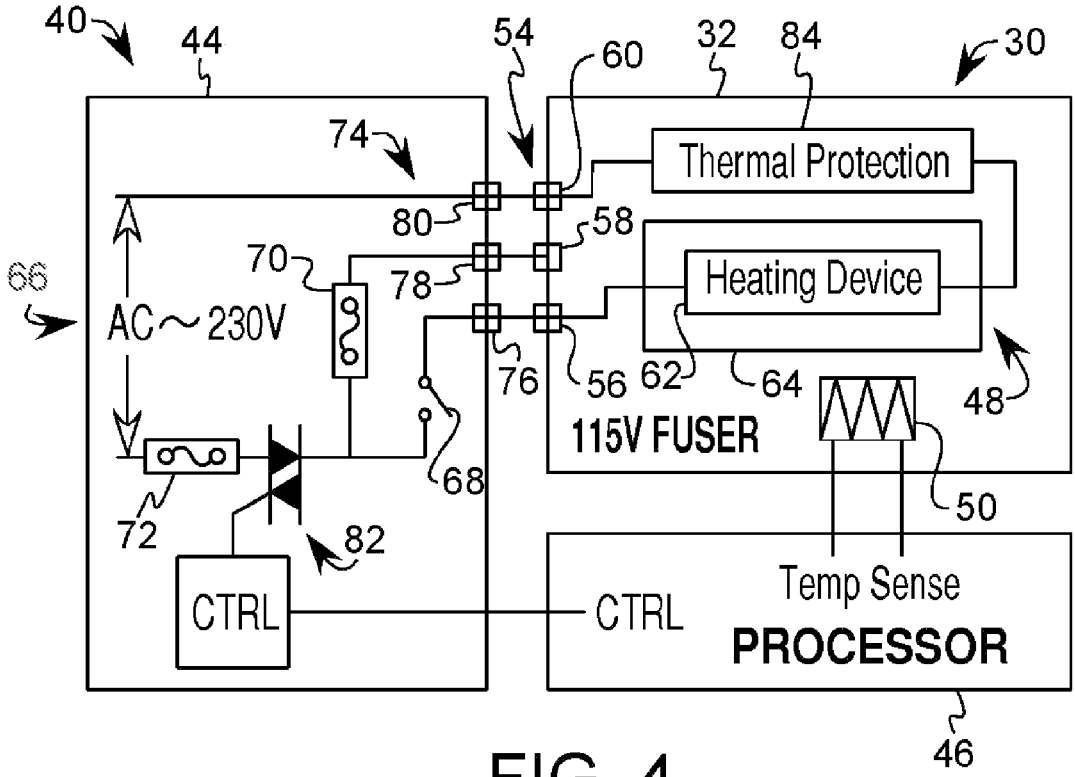
FIG. 4 is a block diagram illustration of a power supply control system according to the present invention, in which a power supply operating at 230V is coupled to a 115V fuser assembly.
Figure 5:
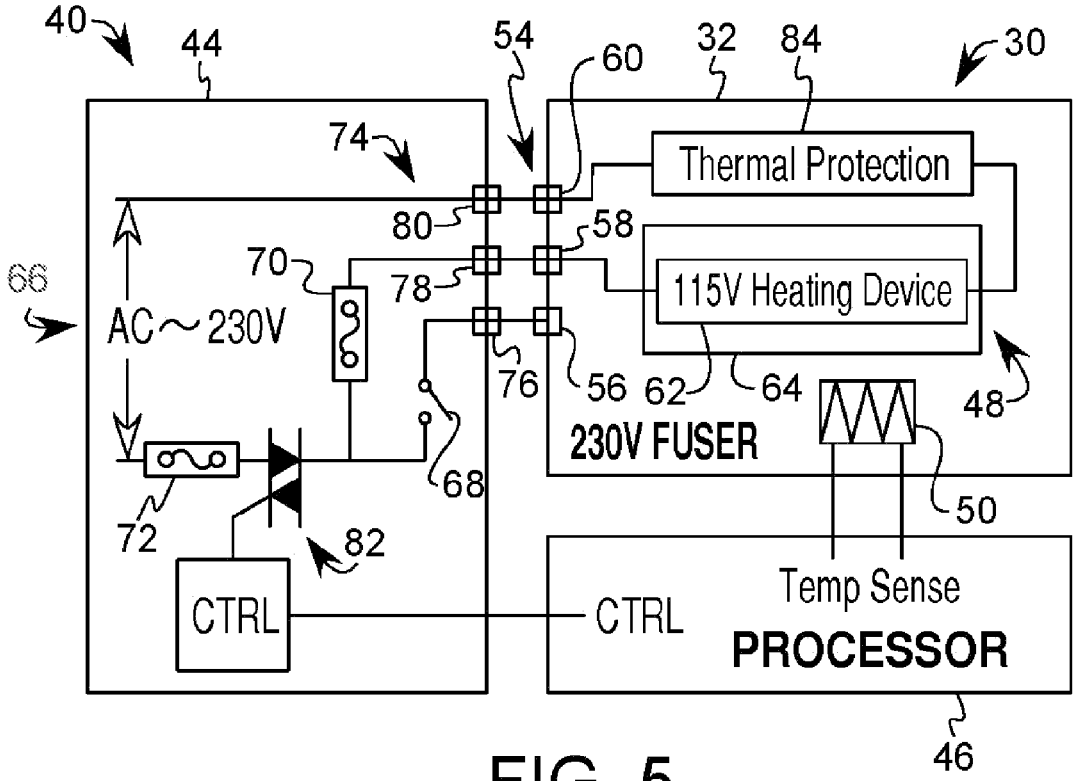
FIG. 5 is a block diagram illustration of a power supply control system according to the present invention, in which a power supply operating at 230V is coupled to a 230V fuser assembly having a 115V heating device installed therein.
Figure 6:
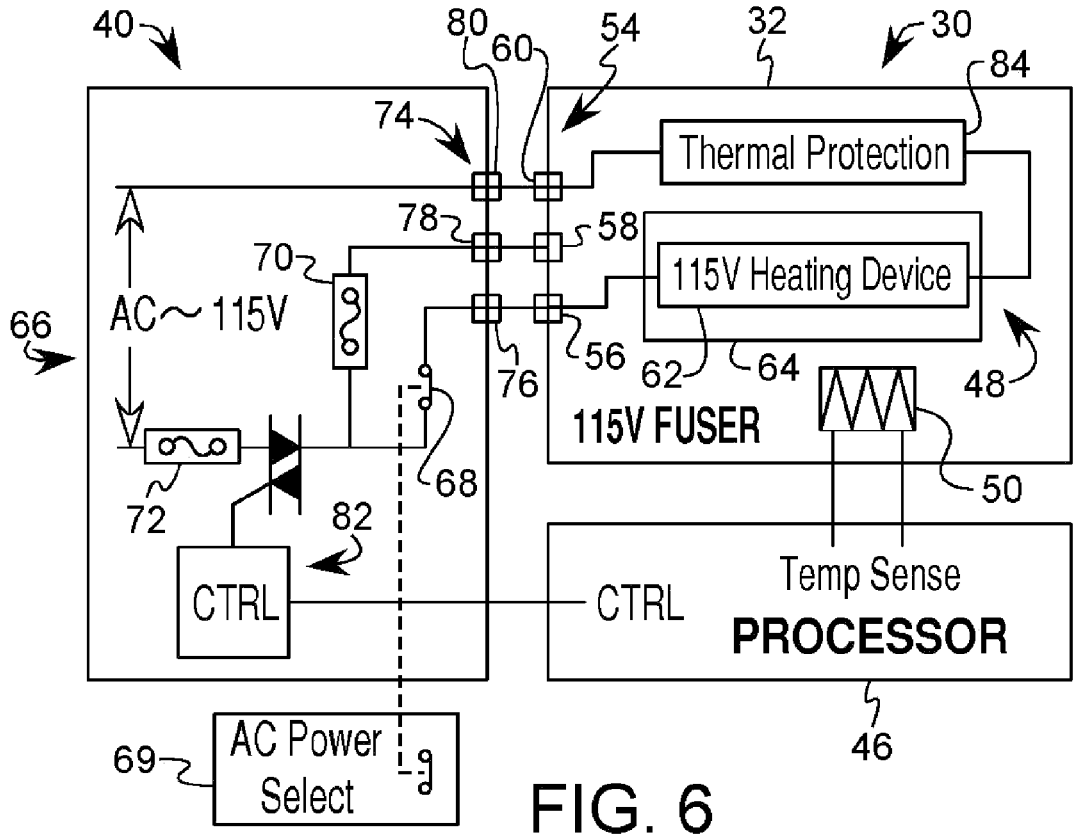
FIG. 6 is a block diagram illustration of a power supply control system according to the present invention, in which a power supply operating at 115V is coupled to a 115V fuser assembly having a 115V heating device installed therein.
Figure 7:
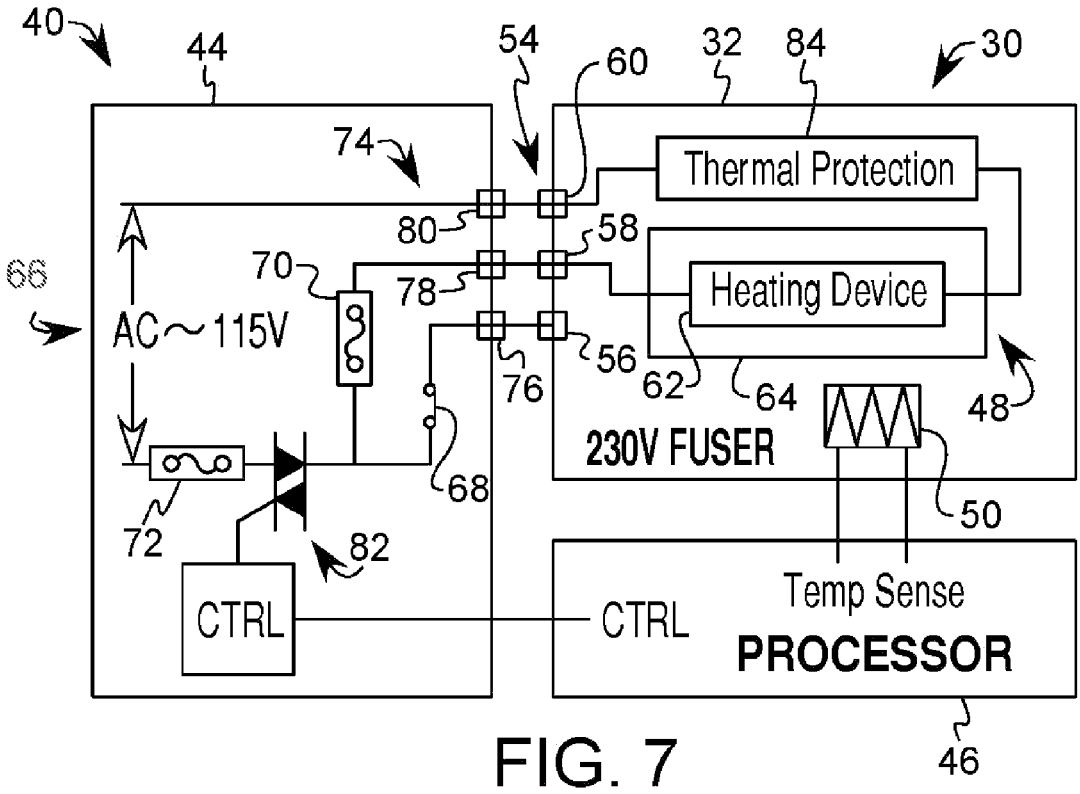
FIG. 7 is a block diagram illustration of a power supply control system according to the present invention, in which a power supply operating at 115V is coupled to a 230V fuser assembly.
Figure 8:
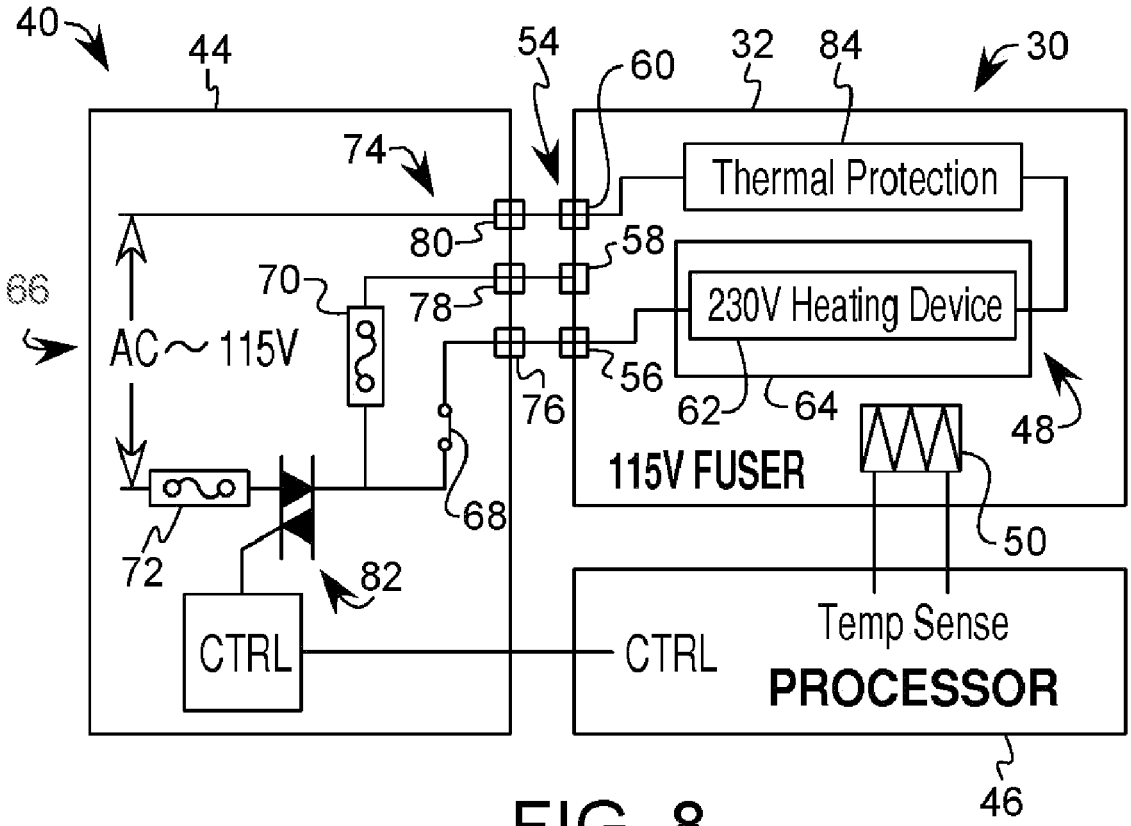
FIG. 8 is a block diagram illustration of a power supply control system according to the present invention, in which a power supply operating at 115V is coupled to a 115V fuser assembly having a 230V heating device installed therein.

With reference to FIGS. 3-8 generally, an exemplary power supply control system 40 is illustrated with respect to various power input and fuser assembly configurations. The power input 66 of the power supply 44 receives the AC line voltage from a suitable power source, which may be a nominal 230VAC supply as illustrated in FIGS. 3-5 or a nominal 115VAC supply as illustrated in FIGS. 6-8. The present invention is not limited however, to operation at 115VAC and 230VAC, or to two nominal voltage ranges.

Within the power supply 44, the first circuit branch is designated as an 115V branch, and the second circuit branch is designated as a 230V branch. As noted above, the fuser assembly 32 and corresponding interconnection between the fuser assembly 32 and the power supply 44 are configured such that the heating device 48 is electrically coupled to a select one of the 115V branch and the 230V branch. Thus, as illustrated, the apparatus 10 may be adapted to geographies that provide either 115V or 230V nominal line voltages by installing a fuser assembly 32 having the appropriate type of heating device 48 that is coupled to the appropriate one of the first or second circuit branches in the power supply 44.

The first and second circuit branches in the power supply 44 allow different types of power limiting devices 68, 70, e.g., a switch and a fuse, to be applied to their associated circuit branch. Alternatively, the first and second power limiting devices 68, 70 may be of the same type, e.g., a fuse, but different rating or have different performance characteristics as described in greater detail below.

In the power supply 44, the first power limiting device 68 may be implemented as a switch. The switch may be either a mechanical switch, a relay, electrical switch or other structure that can selectively form an open or short circuit. As an example, the switch may comprise a mechanical, manually set switch, and may optionally be implemented using a spare pole of a voltage selection switch 69 that is already provided as part of the apparatus, e.g., to select between 115V and 230V nominal voltages at the voltage input 66 of the power supply 44 as schematically represented in FIGS. 3 and 6. The voltage selection switch 69 may be provided as part of a power supply configuration that is not directly related to the fuser per se, e.g., to set the input line voltage to power supply circuitry (not shown) for generating direct current (DC) voltages for operation of motors and/or electronics within the apparatus.

Under this arrangement, the switch opens the 115V path in the first circuit branch when the voltage selection switch 69 is set for 230V operation as illustrated in FIG. 3. Similarly, the switch closes the 115V path in the first circuit branch when the voltage selection switch 69 is set for 115V operation as illustrated in FIG. 6. The switch 69 is omitted from FIGS. 4, 5, 7 and 8 for clarity of discussion. The first power limiting device 68, i.e., the switch, is illustrated in the open position in FIGS. 3-5, designating that the power supply 44 is set for 230V operation. The first power limiting device 68 is illustrated in the closed position in FIGS. 6-9, designating that the power supply 44 is set for 115V operation. The first power limiting device 68 may alternatively comprise a fuse, circuit breaker or other limiting device as set out in greater detail herein.

The second power limiting device 70 is schematically illustrated as a fuse. Depending upon the voltage requirements and application, the type and rating of the fuse must be appropriately selected. In one illustrative example of the present invention, the second power limiting device 70 comprises an International Electrotechnical Commission (IEC) type time lag (surge proof) low breaking capacity fuse, such as Wickmann Series 1951500000. However, other power limiting devices may alternatively be implemented, e.g., such as those described in greater detail herein.

The third power limiting device 72 is provided in the first shared circuit segment and is thus coupled to the electrical pathway to the fuser assembly 32 regardless of whether the line input power is 115V or 230V. As such, the third power limiting device 72 is also designated herein as a shared power limiting device. The third power limiting device 72 may be a fuse having a fuse rating appropriate for both 230V and 115V operation. The third power limiting device 72 may alternatively be any reasonable device that provides some form of power limiting to the power supply 44, e.g., a fuse, circuit breaker, relay etc. Thus, under normal conditions, the first power limiting device 68, e.g., a switch, and the third power limiting device 72, e.g., a fuse, are in series for 115V operation. Correspondingly, under normal conditions, the second power limiting device 70, e.g., a fuse, and the third power limiting device 72, e.g., second fuse, are in series for 230V operation.

Where fuses are implemented, e.g., for the second and/or third power limiting devices 70, 72, IEC fuses, Underwriter's Laboratory (UL) or other appropriate fuses may be used. In this regard, IEC type fuses may exhibit different fuse curves compared to comparable UL type fuses. For example, where the heat source 62 comprises a resistive heat generating device such as a halogen lamp, an inrush current draw may substantially exceed the halogen lamp nominal current draw. As such, the second power limiting device 70 must be able to tolerate relatively short time intervals of current levels that may significantly exceed the rated specification for the fuse. Appropriate fuse selection may also consider tolerances in the fuse ratings, e.g., in the overload characteristics, of the fuse. Moreover, the input voltage will likely vary from the designated nominal voltage. Thus, the relevant constraints in the particular fuser assembly 32 must be evaluated to determine the appropriate fuse type and fuse rating. Further, other non-fuse alternatives may be used so long as such devices satisfy the appropriate constraints in a manner analogous to that described above.

The fuser assembly 32 may further include a thermal device 84 such as a thermal Cut Out device (TCO), which is placed, for example, in series between the third fuser-side connection point 60 and the heating device 48. The thermal device 84 may be located proximate to the heating device 48 and acts as thermal switch that will open electrically if the temperature of the heating device 48 exceeds a designed-for parameter. The TCO may comprise for example, a pellet type TCO or a bimetallic TCO. Further, two or more TCOs may be provided in series, e.g., for redundancy.

It is desirable to provide consistent fuser operation regardless of the geography and power supply 44 requirements. Thus, at least a portion of the fuser assembly 32 may need to be specific to a given geography. For example, assume that a fusing application requires 835 watts of power and that the heat source 62 comprises a resistive source, such as a halogen lamp. In a geography that provides 115V nominal power, a resistive heating device having approximately 16Ω nominal resistance is required. However, if the geography provides 230V nominal power, then a resistive heating device having approximately 64Ω nominal resistance is required. Thus, the resistive heating device 48 intended for 230V operation has approximately four times the resistance as a comparable heating device required for 115V operation to maintain the designed-for power requirement of 835 watts.

With reference to FIG. 3, the power supply control system 40, which is configured for 230V operation, is coupled to a properly configured 230V fuser assembly 32. The 230V fuser assembly 32 thus corresponds to second type fuser assembly discussed herein with reference to FIG. 2. The power supply 44 receives a nominal 230V input voltage. The first power limiting device 68, which is implemented as a switch, is in the open position. The second power limiting device 70 is implemented as a fuse that is selected to accommodate a 230V supply voltage delivered to a 230V fuser assembly 32 having a suitably designed 230V heating device 48. Keeping with the above example, the heating device 48, e.g., a halogen lamp, is designed for an application requiring 835 watts of power at 230V. Thus, the 230V heating device should, under steady state conditions, have a nominal resistance of approximately 64Ω. Given the designed-for power requirements and operating voltage, the second power limiting device 70 may comprise an IEC 5A/250V fuse, such as Wickmann Series 1951500000. Under this arrangement, the 230V input to the power supply 44 is coupled to the heating device 48 of the fuser assembly 32 via the second circuit branch of the power supply 44. The first circuit branch of the power supply 44 does not form a completed circuit with the fuser assembly 32.

If the switch defining the first power limiting device 68 is inadvertently closed, the power supply connection to the fuser assembly 32 is unaffected. This can be seen because the illustrated 230V heating device 48 in the fuser assembly 32 has no electrical connection to the first fuser-side connection point 56 of the fuser-side power connector body 54.

With reference to FIG. 4, there is a possibility that an installed fuser assembly 32 is incompatible with the selected configuration of the power supply 44. For example, as illustrated, an 115V fuser assembly 32 is installed in an apparatus having a power supply 44 that is configured for 230V operation. In the fuser assembly 32, the illustrated heating device 48 is electrically coupled to the first fuser-side connection point 56. However, the switch, which implements the first power limiting device 68 is in an open state, thus no power will flow through the first circuit branch in the power supply to the fuser assembly 32. Accordingly, no power will be supplied to the fuser assembly 32 via the interconnection of the first fuser-side connection point 56 to the first power supply-side connection point 76.

Moreover, the heating device 48 is unconnected within the fuser assembly 32 to the second fuser-side connection point 58. Thus, power cannot flow through the heating device 48 via the second circuit branch in the power supply 44, and the corresponding interconnection between the second fuser-side connection point 58 and the second power supply-side connection point 78. In the example illustrated in FIG. 4, it does not matter whether the heating device 48 is a first type heating device, e.g., intended for 115V operation, or whether the heating device 48 is a second type heating device, e.g., intended for 230V, because the heating device 48 cannot receive power from the power supply 44. Under such an arrangement, the heating device 48 will not generate heat. The lack of heat may be sensed via the first sensor 50 in the fuser assembly 32 and the corresponding processing logic in the power supply processor 46 and an appropriate error message may be provided to the user.

With reference to FIG. 5, it is also possible that an improper heating device 48 is installed in a properly configured fuser assembly 32. Assume that during manufacturing, a first type heating device, e.g., an 115V heating device, is installed in a 230V fuser assembly, which is interconnected to a properly configured 230V power supply 44.

Keeping with the above example of an 835 watt designed-for power requirement, the nominal resistance of a resistive heating device intended for 115V operation is approximately 4 times lower than a comparable resistive heating device intended for 230V operation. Thus the 115V heating device will have a nominal resistance of approximately 16Ω. As such, if a resistive heating device intended for 115V is installed in a fuser assembly 32 intended for 230V operation, which is interconnected to a 230V power supply, then the fuser assembly 32 would nominally draw approximately 4 times the typically expected power under steady state conditions. The heating device 48 will correspondingly begin to heat up more rapidly than the system anticipates. Under such conditions, the second power limiting device 70 will disrupt power supplied to the fuser assembly 32 if the amount of current that would otherwise flow through the heating device 48 exceeds the designed-for conditions of the second power limiting device 70, e.g., thus blowing the fuse.

There are relatively high inrush currents which flow when cold halogen lamps are turned on. Moreover, halogen lamps designed for 115V operation have lower resistances than those designed for 230V operation, so their initial cold inrush currents are also higher. Thus, by splitting the electrical paths of the 115V and 230V input voltages in the power supply 44 along the respective first and second circuit branches, the second power limiting device 70 can be suitably designed to address conditions that exceed anticipated normal 230V operation.

With specific reference to FIG. 6, the power supply control system 40 is illustrated in a manner that is properly configured for 115V operation with a properly constructed 115V fuser assembly 32. The power supply 44 receives a nominal 115V input voltage. In the power supply 44, the first power limiting device 68, which is implemented as a switch, is in the closed position, which allows power to travel along the first circuit branch to the first power supply-side connection point 76. Within the fuser assembly 32, the heating device 48 is electrically coupled to the first fuser-side connection point 56, which is coupled to the corresponding first power supply-side connection point 76. Moreover, the second fuser side-connection point 58 is not connected to the heating device 48 in the fuser assembly 32. Thus, the second circuit branch of the power supply 44 does not form a completed circuit with the fuser assembly 32.

Keeping with the above example of an 835 watt designed-for power requirement, the 115V heating device should, under steady state conditions, have a nominal resistance of approximately 16Ω. The 115V input to the power supply 44 is coupled to the heating device 48 of the fuser assembly 32 via the first circuit branch of the power supply 44. However, the second circuit branch of the power supply 44 does not form a completed circuit with the fuser assembly 32.

With reference to FIG. 7, there is a possibility that an installed fuser assembly 32 is incompatible with the selected configuration of the power supply 44. For example, as illustrated, a 230V fuser assembly 32 is installed in an apparatus having a power supply 44 that is configured for 115V operation. In the fuser assembly 32, the illustrated heating device 48 is electrically coupled to the second fuser-side connection point 58. However, the heating device 48 is unconnected to the first fuser-side connection point 56. Thus, no power will be supplied to the fuser assembly 32 via the interconnection of the first fuser-side connection point 56 to the first power supply-side connection point 76 on the power supply 44. However, the heating device 48 is connected to the second circuit branch of the power supply 44.

If the 230V fuser assembly 32 has a properly installed 230V heating device, then the power that the fuser assembly 32 will draw under steady state conditions will be significantly less than anticipated by the designed-for conditions of the heating device 48. Keeping with the above example an 835 watt designed-for power requirement, a 230V heating device has a resistance of approximately 64Ω. Thus, the 230V heating device 48 supplied with 115V will only draw approximately 209 watts of power through the second circuit branch of the power supply 44, compared to the expected 835 watts. The relatively low power draw of the fuser assembly 32 will not be sufficient to blow the fuse in the second circuit branch of the power supply. However, the fuser assembly 32 will begin to heat up much more slowly than anticipated.

Under such conditions, the fuser processor 46 may be able to suitably detect that the wrong fuser assembly 32 or heating device 48 is installed in the apparatus based upon the additional time that it would take for the fuser assembly 32 to warm up, e.g. by keeping track of measurements from the first sensor 50 as a function of time. The fuser processor 46 can then register an error, record the error in NVRAM, and/or provide an operator panel message to demand that the correct fuser assembly 32 be installed. Moreover, if the fuser processor 46 did not take action to turn off the power supplied to the fuser assembly 32, then the thermal protection device 84 will turn off power to the heating device 48 if excessive temperature is generated. The thermal protection device 84 has sufficient time to react to temperatures that may exceed designed-for parameters due to the relatively lower heating rate of a 230V heating device compared to a proper heating device 48 intended for 115V operation.

As a second example, assume that an improper type heating device 48 was installed in the fuser assembly 32 of FIG. 7. This may occur where an 115V heating device 48 is installed in the 230V fuser assembly. Under this arrangement, the current drawn by the 115V heating device 48 through the second circuit branch of the power supply 44 may be sufficient to blow the fuse. If the fuse in the second circuit branch does not blow, the fuser assembly 32 will attempt to draw an appropriate amount of power, e.g., 835 watts. However, the fuser processor 46 and the thermal protection device 84 have sufficient time to react to temperatures that may exceed designed-for parameters.

With reference to FIG. 8, it is also possible that an improper heating device 48 is installed in a properly configured 115V fuser assembly 32. Assume that during manufacturing, a second type heating device, e.g., a 230V heating device, is installed in a 115V fuser assembly, which is interconnected to a properly configured 115V power supply 44. As noted in the above example, the 230V heating device 48 will output approximately ¼ of the power of a corresponding heating device 48 intended for 115V because the 230V heating device 48 has nominally four times the anticipated resistance. Thus, the fuser processor 46 may be able to suitably detect that the wrong heating device 48 is installed based upon the additional time that it would take for the fuser assembly 32 to warm up, e.g. by keeping track of measurements from the first sensor 50 as a function of time as noted above.

Although the present invention has been illustrated in the context of an exemplary color laser printer, the present invention may be applied generally to monochrome or color devices. Moreover, the present invention is applicable to electrophotographic apparatuses generally, which may include laser printers, copiers, facsimile machines, multifunction machines, and like devices.

Having described the invention in detail and by reference to preferred embodiments thereof, it will be apparent that modifications and variations are possible without departing from the scope of the invention defined in the appended claims.

What is claimed is:

1. A power supply control system for a fuser assembly in an electrophotographic device comprising:

a power supply that accommodates different input voltages having:

a power supply input configured to receive one of a first voltage or a second voltage;

a first circuit branch coupled to said power supply input that is designated for a first type fuser assembly, said first type fuser assembly corresponding to said first voltage;

a second circuit branch coupled to said power supply input that is designated for a second type fuser assembly, said second type fuser assembly corresponding to said second voltage; and a third circuit branch coupled to said power supply input that is common to said first circuit branch and said second circuit branch;

said power supply being coupled to a select one of said first type fuser assembly or said second type fuser assembly, wherein:

said power supply control system is configured such that installation of said first type fuser assembly to said power supply causes the formation of a circuit from said power supply input, through said first circuit branch of said power supply, through said first type fuser assembly, back to said power supply, though said third circuit branch of said power supply to said power supply input, and said power supply control system is configured such that installation of said second type fuser assembly to said power supply causes the formation of a circuit from said power supply input, through said second circuit branch of said power supply, through said second type fuser assembly and back to said power supply, through said third circuit branch of said power supply to said power supply input.

2. The power supply control system according to claim 1, wherein a first power limiting device is provided in said first circuit branch of said power supply.

3. The power supply control system according to claim 2, wherein said first power limiting device comprises a switch.

4. The power supply control system according to claim 3, wherein said switch both designates a select one of said first and second voltages at said power supply input and selectively opens or closes a point in said first circuit branch of said power supply.

5. The power supply control system according to claim 1, wherein a second power limiting device is provided in said second circuit branch of said power supply.

6. The power supply control system according to claim 5, wherein:

said second power limiting device allows normal operation of said fuser assembly when said second type heating device is coupled to said second circuit branch of said power supply, and said second power limiting device prohibits operation of said fuser assembly if said first type heating device is coupled to said second circuit branch of said power supply.

7. The power supply control system according to claim 6, wherein said second power limiting device comprises a fuse.

8. The power supply control system according to claim 1, wherein a first power limiting device is provided in said first circuit branch of said power supply and a second power limiting device is provided in said second circuit branch of said power supply, wherein said first and second power limiting devices are different types of power limiting devices.

9. The power supply control system according to claim 1, wherein a first power limiting device is provided in said first circuit branch of said power supply and a second power limiting device is provided in said second circuit branch of said power supply, wherein said first and second power limiting devices are the same type of power limiting device having different characteristics.

10. The power supply control system according to claim 1, wherein said power supply further comprises a third power limiting device in an electrical path segment which is in series with each of said first and second circuit branches.

11. An electrophotographic apparatus comprising:

a power supply that accommodates different input voltages having:

a power supply input configured to receive one of a first voltage or a second voltage;

a first power supply-side connection point a second power supply-side connection point and a third power supply-side connection point;

a first circuit branch between said power supply input and said first power supply-side connection point; and a second circuit branch between said power supply input and said second power supply-side connection point; and a third circuit branch between said power supply input and said third power supply-side connection point;

said power supply being coupled to a select one of a first type fuser assembly corresponding to said first voltage and a second type fuser assembly corresponding to said second voltage, wherein:

said first type fuser assembly is electrically coupled to said power supply input, said first circuit branch of said power supply and said third circuit branch of said power supply through said first power supply-side connection point and said third power supply-side connection point when said first type fuser assembly is installed in said electrophotographic apparatus; and said second type fuser assembly is electrically coupled to said power supply input, second circuit branch of said power supply and said third circuit branch of said power supply through said second power supply-side connection point and said third power supply-side connection point when said second type fuser assembly is installed in said electrophotographic apparatus.

12. The electrophotographic apparatus according to claim 11, wherein said first and second type fuser assemblies each comprise a first fuser-side connection point interconnected to said first power-supply side connection point, a second fuser-side connection point interconnected to said second power-supply side connection point and a third fuser-side connection point interconnected to said third power-supply side connection point;

said first type fuser assembly comprises a heating device coupled between said first fuser-side connection point and said third fuser-side connection point, and is electrically isolated from said second fuser-side connection point, and said second type fuser assembly comprises a heating device coupled between said second fuser-side connection point and said third fuser-side connection point and is electrically isolated from said first fuser-side connection point.

13. The electrophotographic apparatus according to claim 11, wherein said power supply further comprises a first power limiting device in said first circuit branch and a second power limiting device in said second circuit branch.

14. The electrophotographic apparatus according to claim 13, wherein said first power limiting device comprises a switch.

15. The electrophotographic apparatus according to claim 14, wherein said switch both designates a select one of said first and second voltages at said power supply input and selectively opens or closes a point in said first circuit branch of said power supply.

16. The electrophotographic apparatus according to claim 13, wherein said second power limiting device comprises a fuse.

17. The electrophotographic apparatus according to claim 13, wherein said first and second power limiting devices comprise different types of power limiting devices.

18. The electrophotographic apparatus according to claim 13, wherein said first and second power limiting devices are the same type of power limiting device having different characteristics.

19. The electrophotographic apparatus according to claim 11, wherein said power supply further comprises a first power limiting device in said first circuit branch, a second power limiting device in said second circuit branch and a third power limiting device in an electrical path segment which is in series with each of said first and second circuit branches.

20. An electrophotographic apparatus configured to accommodate different types of fuser assemblies having different voltage requirements comprising:

a power supply having a power supply input configured to receive one of a first voltage or a second voltage; and a select one of a first type fuser assembly or a second type fuser assembly, wherein each of said first and second type fuser assemblies include a first fuser-side connection point, a second fuser-side connection point and a third fuser-side connection point: wherein said first type fuser assembly comprises a first heating device that is coupled to said first fuser-side connection point and said third fuser-side connection point and is electrically isolated from said second fuser-side connection point;

said second type fuser assembly comprises a second heating device that is coupled to said second fuser-side connection point and is electrically isolated from said first fuser-side connection point;

a first electrical connection between said power supply and said first fuser-side connection point of said first type fuser assembly is formed when said first type fuser assembly is installed in said apparatus; and a second electrical connection between said power supply and second fuser-side connection point of said second type fuser assembly is formed when said second type fuser assembly is installed in said apparatus.

21. The electrophotographic apparatus according to claim 20, wherein:

said power supply further comprises a first circuit branch that is coupled to said first fuser-side connection point and a second circuit branch that is coupled to said second fuser-side connection point.

22. The electrophotographic apparatus according to claim 21, wherein said power supply further comprises a first power limiting device in said first circuit branch and a second power limiting device in said second circuit branch and said first and second power limiting devices are different types of power limiting devices.

23. The electrophotographic apparatus according to claim 22, wherein said first power limiting device comprises a switch and said second power limiting device comprises a fuse.

24. The electrophotographic apparatus according to claim 21, wherein said power supply further comprises a first power limiting device in said first circuit branch and a second power limiting device in said second circuit branch and said first and second power limiting devices are the same type of power limiting device having different characteristics.

25. The electrophotographic apparatus according to claim 21, wherein said power supply further comprises a first power limiting device in said first circuit branch, a second power limiting device in said second circuit branch and a third power limiting device in an electrical path segment which is in series with each of said first and second circuit branches.

* * * * *